United States Patent [19]

Au et al.

[11] Patent Number: 4,857,880

[45] Date of Patent: Aug. 15, 1989

[54] ELECTRICAL DEVICES COMPRISING CROSS-LINKED CONDUCTIVE POLYMERS

[75] Inventors: Andrew N. Au, Union City; Marguerite E. Deep, Los Altos; Timothy E. Fahey, San Jose; Stephen M. Jacobs, Cupertino, all of Calif.

[73] Assignee: Raychem Corporation, Menlo Park, Calif.

[21] Appl. No.: 153,178

[22] Filed: Feb. 8, 1988

Related U.S. Application Data

[63] Continuation of Ser. No. 711,910, Mar. 14, 1985, Pat. No. 4,724,417.

[51] Int. Cl.[4] ..... H01C 7/10

[52] U.S. Cl. ..... 338/22 R; 338/225 D; 219/549; 219/553; 264/104

[58] Field of Search ..... 338/22 R, 225 D, 23, 338/212; 264/104, 105; 219/549, 506, 510, 511, 553

[56] References Cited

U.S. PATENT DOCUMENTS

| | | | |
|---|---|---|---|
| 3,351,882 | 11/1967 | Kohler et al. | 338/322 |
| 3,571,777 | 3/1971 | Tully | 338/20 |
| 3,823,217 | 7/1974 | Kampe | 264/105 |
| 3,861,029 | 1/1975 | Smith-Johannsen et al. | 29/611 |
| 4,304,987 | 12/1981 | van Konynenburg | 219/553 |
| 4,317,027 | 2/1982 | Middleman et al. | 219/553 |
| 4,352,083 | 9/1982 | Middleman et al. | 338/23 |
| 4,388,607 | 6/1983 | Toy et al. | 338/22 |
| 4,534,889 | 8/1985 | van Konynenburg et al. | 252/511 |
| 4,591,700 | 5/1986 | Sopory | 219/505 |

FOREIGN PATENT DOCUMENTS

| | | |
|---|---|---|
| 0038716 | 10/1981 | European Pat. Off. . |
| 0038717 | 10/1981 | European Pat. Off. . |
| 2061830 | 6/1972 | Fed. Rep. of Germany . |
| 1424016 | 12/1966 | France . |
| 2214947 | 8/1974 | France . |
| 2368127 | 5/1978 | France . |

*Primary Examiner*—E. A. Goldberg
*Assistant Examiner*—M. M. Lateef
*Attorney, Agent, or Firm*—Marguerite E. Gerstner; Timothy H. P. Richardson; Herbert G. Burkard

[57] ABSTRACT

Electrical devices containing PTC conductive polymers which have been cross-linked in two steps, preferably by radiation. The conductive polymer is heat-treated above the temperature at which it begins to melt between the two cross-linking steps, and/or the cross-linking steps are such that a center section of the conductive polymer, intermediate the electrodes, is substantially more cross-linked than the conductive polymer adjacent the electrodes. The process is particularly useful for the preparation of circuit protection devices which are subject to high voltage faults.

20 Claims, 2 Drawing Sheets

ELECTRICAL DEVICES COMPRISING CROSS-LINKED CONDUCTIVE POLYMERS

CROSS REFERENCE TO RELATED APPLICATIONS

This application is a continuation of copending application Ser. No. 711,910 filed on Mar. 14, 1985, now U.S. Pat. No. 4,724,417, issued Feb. 9, 1988, the entire disclosure of which is incorporated by reference herein.

BACKGROUND OF THE INVENTION

1. Field of the Invention

This invention relates to electrical device comprising PTC conductive polymers.

2. Introduction to the Invention

Conductive polymer compositions exhibiting PTC behavior, and electrical devices comprising them, are well comprising PTC conductive, for example, to U.S. Pat. Nos. 2,952,761; 2,978,665; 3,243,753; 3,351,882; 3,571,777; 3,757,086; 3,793,716; 3,823,217; 3,858,144; 3,861,029; 3,950,604; 4,017,715; 4,072,848; 4,085,286; 4,117,312; 4,177,376; 4,177,446; 4,188,276; 4,237,441; 4,242,573; 4,246,468; 4,250,400; 4,252,692, 4,255,698, 4,271,350, 4,272,471, 4,304,987, 4,309,596, 4,309,597, 4,314,230, 4,314,231, 4,315,237, 4,317,027, 4,318,881, 4,327,351, 4,330,704, 4,334,351, 4,352,083, 4,388,607, 4,398,084, 4,435,639, 4,429,216, and 4,442,139; J. Applied Polymer Science 19, 813–815 (1975), Klason and Kubat; Polymer Engineering and Science 18, 649–653 (1978), Narkis et al; and commonly assigned U.S. Ser. Nos. 601,424 now abandoned, published as German OLS No. 1,634,999; 732,792 (Van Konynenburg et al), now abandoned, published as German OLS No. 2,746,602; 798,154 (Horsma et al), now abandoned, published as German OLS No. 2,821,799; 134,354 (Lutz); 141,984 (Gotcher et al), published as European Application No. 38,718; 141,988 (Fouts et al), published as European Application No. 38,718, 141,989 (Evans), published as European Application No. 38,713, 141,991 (Fouts et al), published as European Application No. 38,714, 150,909 (Sopory), published as UK Application No. 2,076,106A, 184,647 (Lutz), 250,491 (Jacobs et al) now abandoned in favor of Continuation Application Ser. No. 656,046 and 254,352 (Taylor), published as European Application No. 63,440, 272,854 and 403,203 (Stewart et al), published as European Patent Application No. 67,679, 274,010 (Walty et al), 300,709 and 423,589 (van Konynenburg et al), published as European Application No. 74,281, 349,505 (McTavish et al), published as European Application No. 87,884, 369,309 (Midgley et al), 380,400 (Kamath), published as European Application No. 96,492, 474,390 (Leary), 483,633 (Wasley), 485,572 (Nayak et al), 493,445 (Chazan et al), 493,390 (Leary et al), 509,897 (Masia et al), 524,482 (Tomlinson et al), 534,913 (McKinley), 535,449 (Cheng et al) 552,649 (Jensen et al), 573,099 (Batliwalla et al), 904,736, published as UK Pat. Nos. 1,470,502 and 1,470,503, 628,945 (Carlomagno), and 650,918 and 650,920 (Batliwalla et al) (MP0959, 961 and 962). The disclosure of each of the patents, publications and applications referred to above is incorporated herein by reference.

Particularly useful devices comprising PTC conductive polymers are self-regulating heaters and circuit protection devices. Self-regulating heaters are hot and have relatively high resistance under normal operating conditions. Circuit protection devices are relatively cold and have a relatively low resistance under normal operating conditions, but are "tripped", i.e., converted into a high resistance state, when a fault condition, e.g., excessive current or temperature, occurs. When the device is tripped by excessive current, the current passing through the PTC element causes it to self-heat to an elevated temperature at which it is in a high resistance state. Circuit protection devices and PTC conductive polymer compositions for use in them, are described for example in U.S. Pat. Nos. 4,237,411, 4,238,812, 4,255,698, 4,315,237, 4,317,017, 4,329,726, 4,352,083, 4,413,301, 4,450,496, 4,475,138, 4,481,498, and 4,562,313; in U.S. application Ser. No. 254,352 which is now U.S. Pat. No. 4,426,633; and in copending, commonly assigned U.S. application Ser. Nos. 141,989 (MP0715), and 754,807 (MP0906). Other applications which are related to this application are the copending, commonly assigned applications filed contemporaneously with this application by Deep et al, Ser. No. 711,909 (MP1022), by Carlomagno, Ser. No. 711,790 (MP0991), now U.S. Pat. No. 4,685,025, by Ratell, Ser. No. 711,907 (MP1021), now U.S. Pat. No. 4,647,894, and by Ratell, Ser. No. 711,908 (MP1016), now U.S. Pat. No. 4,647,896. The disclosure of each of these patents and prior filed pending applications is incorporated herein be reference.

In many devices, and especially in circuit protection devices, it is desirable or necessary for the PTC conductive polymer to be cross-linked, preferably by means of radiation. The effect of the cross-linking depends on, among other things, the polymer and the conditions during the cross-linking step, in particular the extent of the cross-linking, as discussed for example in copending, commonly assigned U.S. application Ser. No. 468,768, the disclosure of which is incorporated herein by reference. When a conductive polymer element is irradiated, the radiation dose absorbed by a particular part of the element in a given time depends upon its distance from the surface of the element exposed to the source, and the intensity, energy and type of the radiation. For a relatively thin element and a highly penetrating source (e.g. a Cobalt 60 source), the variation of dose with thickness is negligible. However, when using an electron beam, the variation in dose with thickness can be substantial; this variation can be offset by exposing the element to radiation from different directions, e.g. by traversing the element past the source twice, irradiating it first on one side and then on the other. Depending upon the energy of the beam and the thickness of the element (which can of course vary, depending upon its shape), the radiation dose can be higher at the surfaces exposed to radiation than at the middle, or substantially uniform across the thickness of the element, or higher at the middle than at the surfaces exposed to radiation. In addition, the radiation dose near the surface exposed to the radiation can be less than expected because of surface scattering, and the radiation dose in the vicinity of the electrodes is affected by the shielding effect and the scattering effect of the electrodes.

SUMMARY OF THE INVENTION

It has now been discovered that a PTC conductive polymer based on a crystalline polymer has substantially improved electrical properties, in particular when subjected to high voltage stress, if it is cross-linked in two steps and is heated between the cross-linking steps, to a temperature above the temperature at which the crystals begin to melt (referred to herein as $T_I$), and preferably above the temperature at which melting of the crystals is complete (referred to herein as $T_M$). For example, if two identical circuit protection devices are irradiated to the same total dose, one in two steps with no intermediate heat-treatment step, and the other in two steps with an intermediate heat-treatment above $T_M$, the latter product has substantially better tolerance to repeated "tripping" at high voltages (e.g. at 600 volts AC and 1 amp) and the PTC element does not get as hot during the "tripping" process. It is theorized that the new process results in a different cross-linked structure such that the resistivity/temperature curve of the conductive polymer is changed so that at least at some elevated resistances, a particular device resistance is reached at a lower temperature.

It has also been discovered that a PTC conductive polymer device has improved properties, for example a broader hot line and/or a more rapid response, if it is cross-linked in such a way that a center section between the electrodes absorbs a radiation dose which is at least 1.5 times the radiation dose absorbed by portions of the PTC element adjacent the electrodes.

Particularly useful results are obtained when these two discoveries are combined. For example, in this way it is possible to produce circuit protection devices which will withstand repeated tripping at 1 amp and 600 volts AC and which, for a particular resistance, will trip more rapidly than a similar device in which the whole of the PTC element is irradiated in both steps.

In its first aspect, this invention provides a process for the preparation of an electrical device which comprises (1) a PTC element composed of a cross-linked conductive polymer composition which exhibits PTC behavior and which comprises a polymeric component comprising a crystalline polymer and, dispersed in the polymeric component, a particulate conductive filler; and (2) two electrodes which are electrically connected to the PTC element and which are connectable to a source of electrical power to cause current to pass through the PTC element, which process comprises the steps of:

(a) subjecting at least part of the PTC element to a first cross-linking step, (b) heating at least part of the cross-linked PTC element to a temperature above $T_I$, where $T_I$ is the temperature at which the conductive polymer starts to melt, (c) cooling the cross-linked and heated PTC element to recrystallize the polymer; and (d) subjecting at least part of the cross-linked, heated and cooled PTC element to a second cross-linking step to effect further cross-linking thereof.

In its second aspect, this invention provides a circuit protection device which has a resistance of less than 100 ohms and which can be prepared by process as defined above and which comprises (1) a PTC element composed of a cross-linked conductive polymer composition which exhibits PTC behavior and which comprises a polymeric component comprising a crystalline polymer and, dispersed in the polymeric component, a particulate conductive filler; and (2) two electrodes which are electrically connected to the PTC element and which are connectable to a source of electrical power to cause current to pass through the PTC element;

said PTC element, if said circuit protection device is converted into an equilibrium high temperature, high resistance state by passing through the device a current of 1 amp from a power source of 600 volts AC, having a maximum temperature in the equilibrium state which is at most 1.2 times $T_M$, where $T_M$ is the temperature in °C. at which melting of the conductive polymer is complete. The maximum temperature referred to here and elsewhere in this specification is the maximum temperature on the surface of the PTC element.

In its third aspect this invention provides a process for the preparation of an electrical device which comprises (1) a PTC element composed of a cross-linked conductive polymer composition which exhibits a PTC behavior and which comprises a polymeric component and, dispersed in the polymeric component, a particulate conductive filler; and (2) two electrodes which are electrically connected to the PTC element and which are connectable to a source of electrical power to cause current to pass through the PTC element, which process comprises subjecting the PTC element to radiation cross-linking such that in the resulting product, the geometrically shortest current path between the electrodes through the PTC element comprises in sequence a first section which has absorbed a first dose $D_1$ Mrad, a second section which has absorbed a second dose $D_2$ Mrad, and a third section which has absorbed a third dose $D_3$ Mrad, wherein the ratio $D_2/D_1$ is at least 1.5 and the ratio $D_2/D_3$ is at least 1.5, $D_1$ and $D_3$ being the same or different. In this process, the cross-linking is preferably carried out in two steps, part only of the PTC element being irradiated in at least one of the steps. However, the invention includes other processes in which different parts of the PTC element absorb different amounts of radiation, for example because the density of the PTC element varies or the amount of cross-linking agent in the PTC element varies.

BRIEF DESCRIPTION OF THE DRAWING

The invention is illustrated in the accompanying drawing in which.

DETAILED DESCRIPTION OF THE INVENTION

Figure 1:
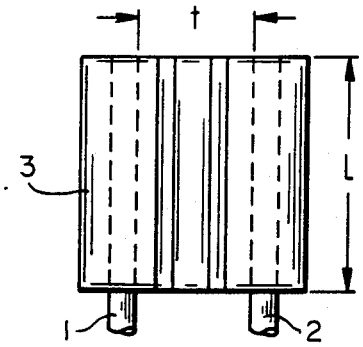
FIGS. 1, 2 and 3 are front, plan and side views respectively of a circuit protection device of the invention.

The cross-linking of the PTC conductive polymer is preferably effected by means of radiation in two steps, and will be chiefly described herein by reference to such cross-linking. However, it is to be understood that the invention is also applicable, to the extent appropriate, to processes which involve chemical cross-linking, for example processes in which the first step involves chemical cross-linking and the second step involves radiation. Depending upon the radiation source and the thickness of the PTC element, each step can (for the reasons outlined above) involve exposing the element to the source one or more times from different directions. Radiation doses given in this specification for the PTC element are the lowest doses absorbed by any effective part of the element, the term "effective part" being used to denote any part of the element in which the radiation dose is substantially unaffected by surface scattering of the radiation, or by shielding by the electrodes, or by scattering by the electrodes, and through which current passes in operation of the device. For example, where this specification states that the radiation dose in step (a) is 5 to 60 Mrad, this means that the lowest dose received by any effective part of the element is in the range of 5 to 60 Mrad, and does not exclude the possibility that other effective parts of the element have received a dose greater than 60 Mrad. Preferably, however, all effective parts of the PTC element receive a dose within the specified range.

When part only of the PTC element is irradiated in one of the cross-linking steps, this can be achieved for example by making use of a narrow radiation source, or by means of masks. The desired effect can be achieved by irradiating different but overlapping parts of the device in the two steps, or by irradiating a first part only of the PTC element in one of the steps and irradiating at least a second part of the PTC element in the other step, the second part being larger than and including at least some of the first part. It is preferred to cross-link the whole of the PTC element in the first step and part only of the PTC element, intermediate the electrodes, in the second step. The radiation is preferably such that, in the product, the geometrically shortest electrical path between the electrodes through the PTC element, and preferably each electrical path between the electrodes through the PTC element, comprises in sequence a first section which has absorbed a first dose $D_1$ Mrad, a second section which has absorbed a second dose $D_2$ Mrad, and a third section which has absorbed a third dose $D_3$ Mrad, $D_1$ and $D_3$ preferably being the same, and $D_2/D_1$ and $D_2/D_3$ being at least 1.5, particularly at least 2.0, especially at least 3.0, e.g. 4.0 or more. As noted above, the known cross-linking procedures can produce some variation in cross-linking density, but not a variation as large as 1.5:1. Furthermore it was not recognized that any advantage could be derived from any such variation, nor was it known to heat-treat the conductive polymer between the cross-linking steps.

Cross-linking a PTC conductive polymer generally increases its resistivity as well as increasing its electrical stability. The increase in resistivity is acceptable in some cases, but in other cases restrictions on the resistance and/or dimensions of the device make it impossible to cross-link the conductive polymer to the extent desired. Especially under these circumstances, it is useful to have a relatively small section of the PTC element, intermediate the electrodes, which has been more highly irradiated than the remainder, thus increasing the stability of the element in the critical "hot zone" area, while not excessively increasing the resistance of the device.

The radiation dose in the first cross-linking step is preferably less than the dose in the second cross-linking step. The dose in the first step is preferably 5 to 60 Mrad, particularly 10 to 50 Mrad, especially 15 to 40 Mrad. The dose in the second step is preferably at least 10 Mrad, more preferably at least 20 Mrad, particularly at least 40 Mrad, especially 50 to 180 Mrad, e.g. 50 to 100 Mrad.

When, as is preferred, at least part of the cross-linked PTC conductive polymer is heated to a temperature above $T_I$, and preferably above $T_M$, between the two cross-linking steps, that temperature is preferably maintained for at least the time required to ensure that equilibrium is reached, e.g. for at least 1 minute, e.g. 2 to 20 minutes. The whole of the PTC element which has been cross-linked in the first step can be heated in this way. Alternatively only part of the element is so heated; this can result in variations between different parts of the PTC element which can be desirable or undesirable depending on circumstances.

The $T_I$ and $T_M$ of the conductive polymer as defined herein can be ascertained from a curve generated by a differential scanning calorimeter, $T_I$ being the temperature at which the curve departs from the relatively straight baseline because the composition has begun to undergo an endothermic transition, and $T_M$ being the peak of the curve. If there is more than one peak on the curve, $T_I$ and $T_M$ are taken from the lowest of the peaks. For further details, reference should be made to ASTM D-3417-83. The heating of the PTC element, which is preferably carried out in an inert, e.g. nitrogen, atmosphere, can be effected by external heating, e.g. in an oven, in which the whole of the PTC element will normally be uniformly heated; or by means of internally generated heat, e.g. by passing a current through the device which is sufficient to make it trip, in which case the heating will normally be confined to a narrow zone of the PTC element between the electrodes.

After it has been heated above $T_I$, the PTC element is cooled to recrystallize the polymer, prior to the second cross-linking step. The cooling is preferably effected slowly, e.g. at a rate less than 7° C./minute, particularly less than 4° C./minute, especially less than 3° C./minute, at least over the temperature range over which recrystallization takes place. Similar heat treatments, again preferably with slow cooling, are preferably carried out before the first cross-linking step and after the second cross-linking step.

There can be some overlap between the different steps of the process. For example the irradiation of the PTC element can be continued while the element is heated to a temperature above $T_I$.

The PTC conductive polymer comprises a polymeric component and a particulate conductive filler. The polymeric component can consist essentially of one or more crystalline polymers, or it can also contain amorphous polymers, e.g. an elastomer, preferably in minor amount, e.g. up to 15% by weight. The crystalline polymer preferably has a crystallinity of at least 20%, particularly at least 30%, especially at least 40%, as measured by DSC. Suitable polymers include polyolefins, in particular polyethylene; copolymers of olefins with copolymerisable monomers, e.g. copolymers of ethylene and one or more fluorinated monomers e.g. tetrafluoroethylene, or one or more carboxyl- or ester-containing monomers, e.g. ethyl acrylate or acrylic acid; and other fluoropolymers, e.g. polyvinylidene fluoride. The conductive filler preferably consists of or contains carbon black. The composition can also contain non-conductive fillers, including arc-suppression agents, radiation cross-linking agents, antioxidants and other adjuvants. For further details, reference should be made to the documents incorporated herein by reference.

This invention is particularly useful in the production of circuit protection devices, especially those which are subject to high voltage faults and which must be capable of repeated "tripping". Such devices generally have a resistance of less than 100 ohms, often less than 50 ohms, at 23° C., and usually make use of PTC conductive polymers having a resistivity of less than 100 ohm.cm, preferably less than 50 ohm.cm, at room temperature. Preferred protection devices of this invention comprise two parallel electrodes which have an electrically active surface of generally columnar shape and which are embedded in, and in physical contact with, the PTC element. The device can have a shape or other characteristic which ensures that when the device is tripped, the to zone forms at a location away from the electrodes (see in particular U.S. Pat. Nos. 4,317,027 and 4,352,083), and when one of the cross-linking steps is carried out on part only of the PTC element, intermediate the electrodes, this can create or enhance such characteristic.

The electrodes and the PTC element are arranged so that the current flows through the element over an area of equivalent diameter with an average path length t such that d/t is at least 2, preferably at least 10, especially at least 20. The term "equivalent diameter" means the diameter of a circle having the same area as the area over which the current flows; this area may be of any shape but for ease of manufacture of the device is generally circular or rectangular. It is generally preferred to use two planar electrodes of the same area which are placed opposite to each other on either side of a flat PTC element of constant thickness. The PTC element will generally have thickness of 0.02 to 0.4 inch, preferably 0.04 to 0.2 inch, and an equivalent diameter of 0.25 to 2 inch, preferably, 0.6 to 1.3 inch, though substantially greater thicknesses and/or equivalent diameters can be used. Cross-linking is preferably effected after the metal foil electrode has been secured to the element.

As noted above, the sequence of cross-link, heat above $T_I$, cool, and cross-link again, results in a device which, when it is tripped (and especially when it is tripped at high voltage), has a cooler "hot zone" than a device which has been cross-linked in a conventional way. The reduction in the maximum temperature of the PTC element is a highly significant improvement since it increases the number of times that the device can be tripped before it fails. This improvement can be demonstrated with the aid of the tests described below, in which the device is tripped by means of a current of 1 amp from a 600 volt AC power source.

The device is made part of a circuit which consists of a 600 volt AC power source, a switch, the device, and a resistor in a series with the device, the device being in still air at 23° C. and the resistor being of a size such that when the switch is closed, the initial current is 1 amp. The switch is then closed, and after about 20 seconds (by which time the device is in an equilibrium state) an infrared thermal imaging system is used to determine the maximum temperature on the surface of the PTC element. Devices according to the invention have a maximum temperature which is less than 1.2 times $T_M$, preferably less than 1.1 times $T_M$, particularly less than $T_M$. Known devices have substantially higher maximum temperatures, e.g. at least 1.25 times $T_M$. If the temperature of the PTC element is monitored while the device is being tripped, it is sometimes found that small sections of the surface of the element reach a temperature greater than 1.2 times $T_M$ for a limited time; however, it is preferred that no part of the surface of the PTC element should reach a temperature greater than 1.2 $T_M$ while the device is being tripped.

The test circuit described above can also be used to test the voltage withstand performance of the device. In this test the switch is closed for 1 second (which is sufficient to trip the device), and the device is then allowed to cool for 90 seconds before the switch is again closed for 1 second. This sequence is continued until the device fails (as evidenced by visible arcs or flames or by significant resistance increase). Preferred devices of the invention have a survival life of at least 100 cycles, preferably at least 120 cycles, particularly at least 150 cycles, in this test.

Preferred circuit protection devices of the invention are particularly useful for providing secondary protection in subscriber loop interface circuits in telecommunication systems.

Figure 2:
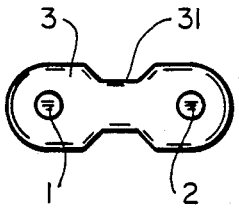
Figure 3:
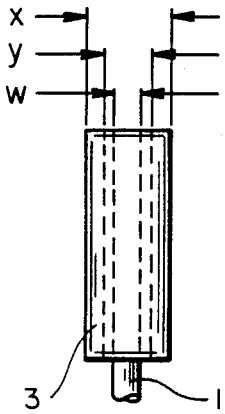

Referring now to the drawing, FIGS. 1, 2 and 3 show face, plan and side views of a circuit protection device comprising columnar electrodes 1 and 2 embedded in, and in physical contact with, a PTC conductive polymer element 3 which has a central section of reduced cross-section by reason of restriction 31. The height of the PTC element is 1, the maximum width of the PTC element is x, the minimum width of the PTC element (in the restricted portion 31) is y, the distance between the electrodes is t, and the width of the electrodes is w.

The invention is illustrated in the following Examples, in which Examples 1 and 2 are comparative Examples.

EXAMPLE 1

The ingredients listed in Table 1 were preblended, mixed in a Banbury mixer, pelletized and dried. Circuit protection devices as illustrated in FIGS. 1–3 (1=0.300 inch, t=0.200 inch, x=0.092 inch, y=0.060 inch, and w=0.032 inch) were made by injection molding the dried pellets around two 20 AWG tin-coated copper wires which have been coated with a graphite emulsion (Electrodag 502, sold by Acheson). The devices were heat-treated in a nitrogen atmosphere by increasing the temperature to 150° C. at 10° C./min.; maintaining them for 1 hour at 150° C.; cooling them to 110° C. at 2° C./min; maintaining them for 1 hour at 110° C., and cooling them to 23° C. at 2° C./min. The devices were then cross-linked by means of a 1 Mev electron beam; the devices were exposed to a dose of 20 Mrad on one side and then to a dose of 20 Mrad on the other side. The devices were then subjected to a second heat-treatment as described above.

EXAMPLE 2

The procedure of Example 1 was followed except that the radiation dose was 80 Mrad on each side of the device.

EXAMPLE 3

The procedure of Example 1 was followed except that after the second heat-treatment, the devices were given a second cross-linking in which the devices were exposed to a dose of 60 Mrad on one side and then to a dose of 60 Mrad on the other side, and then given a third heat-treatment which was the same as the first and second heat treatments.

EXAMPLE 4

The procedure of Example 3 was followed except that the devices were exposed to a dose of 60 Mrad on each side in the first cross-linking step and a dose of 20 Mrad on each side in the second cross-linking step.

EXAMPLE 5

The procedure of Example 3 was followed except that the devices were exposed to a dose of 140 Mrad on each side in the second cross-linking step.

The devices prepared in Examples 1–5 were tested at 600 volts AC and 1 amp by the procedures described above, and the results obtained are shown in Table 2 below.

EXAMPLE 6

The ingredients listed in Table 1 were preblended, mixed in a Banbury mixer, pelletized and dried. Using a Brabender cross-head extruder fitted with a dog-bone shaped die, the pellets were melt-extruded at a temperature of about 160° C. around two 20 AWG 19/32 nickel-coated copper wires which had been coated with a graphite/silicate composition (Electrodag 181 sold by Acheson). The extrudate was cut into 0.46 inch long pieces, and the conductive polymer removed from the bottom 0.20 inch of each piece, to give devices as shown in FIGS. 1 to 3 (l=0.260 inch, t=0.160 inch, x=0.090 inch, y=0.065 inch, and w=0.040 inch).

The devices were heat-treated as in Example 1; cross-linked a first time by exposing them to a dose of 20 Mrad on one side and then to a dose of 20 Mrad on the other side using a 1.5 Mev electron beam; again heat-treated as in Example 1; cross-linked a second time by exposing them to a dose of 100 Mrad on one side and then to a dose of 100 Mrad on the other side, and again heat-treated as in Example 1.

EXAMPLE 7

The ingredients listed in Table 1 were preblended, mixed in a Banbury mixer, granulated and dried. Circuit protection devices as illustrated in FIGS. 1–3 (l=0.375 inch, t=0.466 inch, x=0.060 inch, y=0.034 inch, and w=0.032 inch) were made by injection molding the granules around 20 AWG nickel-coated copper wires. The devices were heat-treated as in Example 1; cross-linked a first time by exposing them to a dose of 20 Mrad (on one side only), using a 1 Mev electron beam; and again heat-treated as in Example 1. Aluminum tape was applied to the devices so as to mask the entire device from electrons except for a strip 0.010 inch wide in the center, parallel to the electrodes; the masked devices were cross-linked a second time by exposing them to a dose of 100 Mrad (on one side); masking material was removed; and the device was again heat-treated as in Example 1.

EXAMPLE 8

The ingredients listed under Example 8 (Master) were preblended, mixed in a Banbury mixer, granulated and dried. The granules were blended with alumina trihydrate in a volume ratio of 83.5 to 16.5, to give a mixture as listed in Table 1 under Example 8 (Final). Using a Brabender cross-head extruder, the mixture was melt-extruded around two preheated parallel 20 AWG 19/32 stranded nickel-coated copper wires and around a solid 24 AWG nickel-coated copper wire midway between the stranded wires. The extrudate was cut into pieces about 1.5 inch long; the conductive polymer was stripped from one end of each piece; and the center wire was withdrawn from each piece, thus producing a circuit protection device consisting of the stranded wires embedded in a conductive polymer element 1 inch long, 0.4 inch wide and 0.1 inch deep, with a hole through the middle where the center wire had been removed. The devices were cross-linked a first time by irradiating them (on one side only) to a dose of 20 Mrad in a nitrogen atmosphere, using a Cobalt 60 gamma source at a rate of 1.2 Mrad/hour. Aluminum sheet 92 mils thick was then used to mask the device except for a strip 0.062 inch wide in the center, parallel to the electrodes. The masked devices were then cross-linked a second time by irradiating them to a dose of 80 Mrad on one side and then to a dose of 80 Mrad on the other side, using a 1 Mev electron beam.

Figure 4:
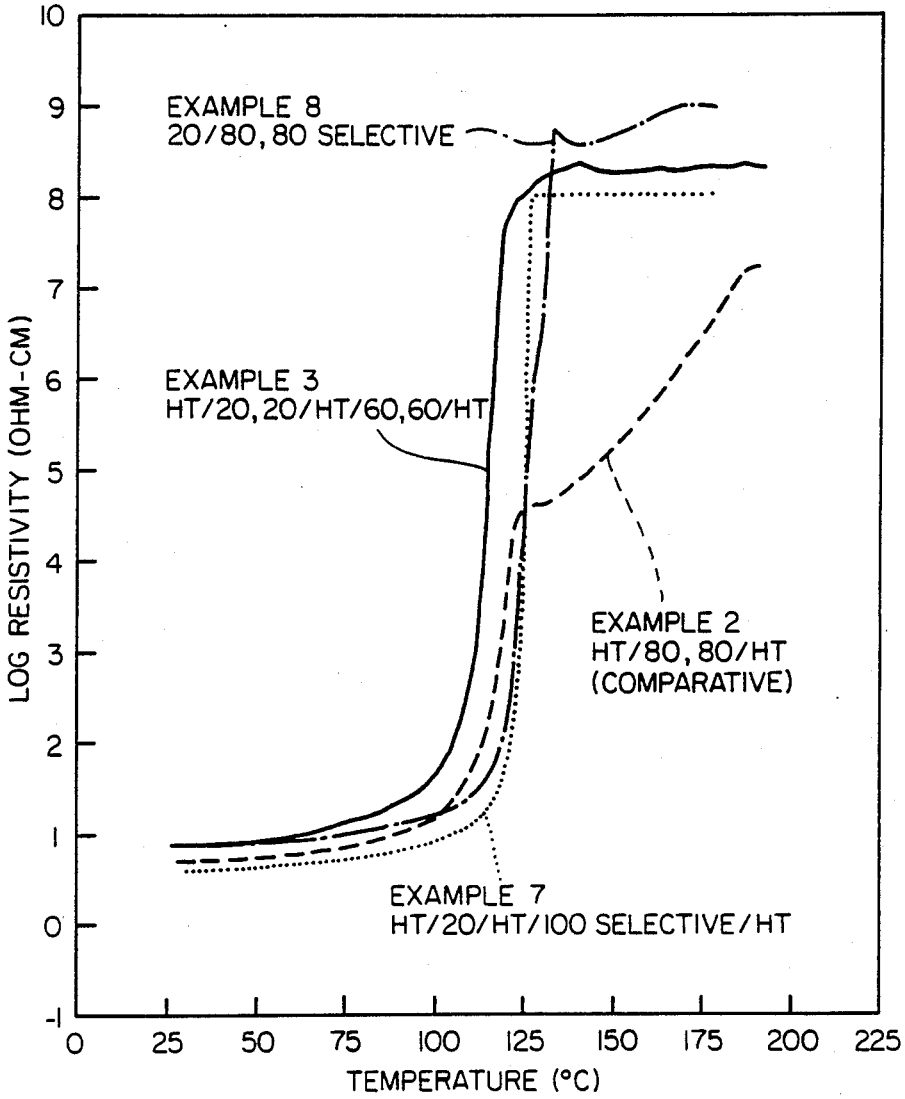
FIG. 4 shows resistivity/temperature curves for devices which have been cross-linked in accordance with the prior art and in accordance with the invention.

The resistance/temperature characteristics of the devices prepared in Examples 2, 3, 7 and 8 were then determined by measuring the resistance of the devices as they were externally heated from 20° C. to 200° C. at a rate of 2° C./minute. The resistivities of the compositions were then calculated, and the results were presented graphically in FIG. 4, in which the flat portions at the top of some of the curves are produced by the maximum resistance which could be measured by the test apparatus.

TABLE 1

| Ingredients (parts by volume) | Example No. 1–5 | 6 | 7 | 8 (master) | 8 (final) |
|---|---|---|---|---|---|
| Polyethylene (1) | 53.7 | 56.7 | — | 66.0 | 55.1 |
| Polyethylene (2) | — | — | 55.0 | — | — |
| Carbon Black 1 | 31.1 | — | 30.0 | 32.0 | 26.7 |
| Carbon Black 2 | — | 25.1 | — | — | — |
| $Al_2O_3.3H_2O$ | — | — | — | — | 16.5 |
| Si—coated $Al_2O_3.3H_2O$(1) | 13.5 | — | 13.0 | — | — |
| Si—coated $Al_2O_3.3H_2O$(2) | — | 16.5 | — | — | — |
| Antioxidant | 1.7 | 1.7 | 2.0 | 2.0 | 1.7 |

Notes

Polyethylene (1) is high density polyethylene having a peak DSC melting point of about 135° C. sold by Phillips Petroleum under the trade name Marlex 6003.

Polyethylene (2) is high density polyethylene having a peak DSC melting point of about 135° C. sold by duPont under the trade name Alathon 7050.

Carbon Black (1) is carbon black sold by Columbian Chemicals under the trade name Statex G.

Carbon Black (2) is carbon black sold by Cabot under the trade name Sterling SO $Al_2O_3$. $3H_2O$ is alumina trihydrate sold by Alcoa under the trade name of Hydral 705.

Si—coated $Al_2O_3$. $3H_2O$ (1) is a silane-coated alumina tri-hydrate having a particle size of 3–4 microns sold by J. M. Huber under the trade name Solem 632SP.

Si—coated $Al_2O_3$. $3H_2O$ (2) is a silane-coated alumina tri-hydrate having a particle size of about 0.8 microns sold by J. M. Huber under the trade name Solem 916SP.

Antioxidant is an oligomer of 4,4-thio bis(3-methyl 1-6-t-butyl phenol) with an average degree of polymerisation of 3–4, as described in U.S. Pat. No. 3,986,981.

TABLE 2

| Example No. | Processing | Max Temp. when tripped | cycles survived |
|---|---|---|---|
| 1 | HT/20,20/HT | 197° C. | 11 |
| 2 | HT/80,80/HT | 174° C. | 60 |
| 3 | HT/20,20/HT/60,60/HT | 128° C. | 157 |
| 4 | HT/60,60/HT/20,20/HT | 162° C. | 60 |
| 5 | HT/20,20/HT/140,140/HT | 135° C. | >200 |

We claim:

1. A process for the preparation of an electrical device which comprises (1) a laminar PTC element composed of a cross-linked conductive polymer composition which exhibits PTC behavior and which comprises a polymeric component comprising a crystalline polymer and, dispersed in the polymeric component, a particulate conductive filler; and (2) two laminar electrodes which are electrically connected to the PTC element and which are connectable to a source of electrical power to cause current to pass through the PTC element, which process comprises the steps of:

(a) melt-extruding the conductive polymer composition to form a laminar PTC element which does not contain an electrode;

(b) subjecting at least part of the PTC element to a first cross-linking step;

(c) heating at least part of the crosslinked PTC element to a temperature above $T_I$, where $T_I$ is the temperature at which the conductive polymer starts to melt;

(d) cooling the cross-linked and heated PTC element to recrystallize the polymer;

(e) subjecting at least part of the cross-linked, heated and cooled PTC element to a second cross-linking step to effect further cross-linking thereof; and (f) securing laminar electrodes to the PTC element.

2. A process according to claim 1 wherein the PTC element is cross-linked by irradiation in step (b) and in step (e).

3. A process according to claim 2 wherein the whole of the PTC element is irradiated in step (b) and in step (e).

4. A process according to claim 2 wherein the radiation dose in step (b) is 5 to 60 Mrad, and the radiation dose in step (e) is at least 10 Mrad.

5. A process according to claim 2 wherein the radiation dose in step (b) is 10 to 50 Mrad, and the radiation dose in step (e) is 50 to 180 Mrad.

6. A process according to claim 2 wherein the radiation dose in step (b) is 15 to 40 Mrad, and the radiation dose in step (e) is 50 to 100 Mrad.

7. A process according to claim 1 wherein in step (c) the cross-linked PTC element is heated to a temperature above $T_M$, where $T_M$ is the temperature at which melting of the conductive polymer is complete.

8. A process according to claim 1 wherein in step (d) the cross-linked and heated PTC element is cooled at a rate of less then 4° C. per minute over the temperature range in which recrystallization takes place.

9. A process according to claim 2 wherein the electrical device is a circuit protection device having a resistance at room temperature of less than 100 ohms and the conductive polymer composition has a resistivity at 23° C. of less than 50 ohm-cm.

10. A process according to claim 9 wherein the conductive polymer comprises carbon black dispersed in polyethylene.

11. A process according to claim 9 wherein the radiation doses in steps (b) and (e) are such that when the device is converted into a high temperature, high resistance state by passing through the device a current of 1 amp from a power source of 600 volts AC, the PTC element reaches a maximum surface temperature which is at most 1.2 times $T_M$, where $T_M$ is the temperature in degrees C at which melting of the conductive polymer is complete.

12. A process according to claim 2 wherein step (f) is carried out after step (a) and before steps (b) to (e).

13. A process according to claim 2 wherein step (f) is carried out after steps (a) to (e).

14. A process according to claim 2 wherein step (f) is carried out after steps (a) and (b) and before steps (c) to (e).

15. A process according to claim 1 wherein the PTC element is cross-linked by chemical cross-linking in step (b) and by irradiation in step (e).

16. A process according to claim 1 wherein the PTC element has a thickness of at least 0.040 inch.

17. A process according to claim 16 wherein the PTC element has a thickness of at least 0.060 inch.

18. A process according to claim 17 wherein the PTC element has at thickness of at least 0.100 inch.

19. A circuit protection device which has a resistance of less than 100 ohms and which comprises (1) a laminar PTC element composed of a cross-linked conductive polymer composition which exhibits PTC behavior and which comprises a polymeric component comprising a crystalline polymer and, dispersed in the polymeric component, a particulate conductive filler; and (2) two laminar electrodes which are electrically connected to the PTC element and which are connectable to a source of electrical power to cause current to pass through the PTC element;

the cross-linking of said conductive polymer composition being such that, when said circuit protection device is converted into an equilibrium high temperature, high resistance state by passing through the device a current of 1 amp from a power source of 600 volts AC, said PTC element has a maximum surface temperature in the equilibrium state which is at most 1.2 times $T_M$, where $T_M$ is the temperature in degrees C at which melting of the conductive polymer is complete.

20. A device according to claim 19 wherein said maximum surface temperature is at most 1.1 times $T_M$.

* * * * *

UNITED STATES PATENT AND TRADEMARK OFFICE

CERTIFICATE OF CORRECTION

PATENT NO. : 4,857,880

DATED : August 15, 1989

INVENTOR(S) : Andrew N. Au et al

It is certified that error appears in the above-identified patent and that said Letters Patent is hereby corrected as shown below:

In Column 7, line 8, replace "to zone" by --hot zone--.

Signed and Sealed this

Twenty-second Day of October, 1991

*Attest:*

HARRY F. MANBECK, JR.

*Attesting Officer*

*Commissioner of Patents and Trademarks*